United States Patent [19]

Froom

[11] Patent Number: 4,712,689

[45] **Date of Patent: * Dec. 15, 1987**

[54] ICE-CREAM CARTON, CARTON BLANK, AND METHOD OF ERECTING SAME

[76] Inventor: Thomas W. Froom, 10 Burncoat Way, Pittsford, N.Y. 14534

[ * ] Notice: The portion of the term of this patent subsequent to Dec. 15, 2004 has been disclaimed.

[21] Appl. No.: 38,368

[22] Filed: Apr. 14, 1987

Related U.S. Application Data

[63] Continuation-in-part of Ser. No. 866,890, May 23, 1986, Pat. No. 4,712,730.

[51] Int. Cl.[4] ..... B65D 5/54

[52] U.S. Cl. ..... 206/626; 206/631; 229/145; 229/150; 229/152; 229/905; 493/128; 493/114

[58] Field of Search ..... 229/44 R, 132, 135, 229/141, 145, 150, 152, 905, 169, 180; 206/608, 611, 626, 631; 493/114, 128–132, 183

[56] References Cited

U.S. PATENT DOCUMENTS

| | | | |
|---|---|---|---|
| 3,144,980 | 8/1964 | Larson | 229/51 |
| 3,265,285 | 8/1966 | Fanter | 229/51 |
| 3,281,059 | 10/1965 | Buttery et al. | 229/51 |
| 3,315,870 | 4/1967 | Barnes | 229/37 |
| 3,506,184 | 4/1970 | Barnes | 229/51 |
| 4,083,487 | 4/1978 | Zattoni | 229/17 R |
| 4,150,748 | 4/1979 | Mueller | 206/624 |
| 4,555,027 | 11/1985 | Froom | 206/626 |

*Primary Examiner*—Stephen Marcus
*Assistant Examiner*—Gary E. Elkins
*Attorney, Agent, or Firm*—Gordon W. Hueschen

[57] ABSTRACT

A carton for packaging ice cream, having several novel features, including full bottom panel end flaps which have a recess along a major portion of the outer marginal edge thereof which underlies the carton cover panel and front panel end flaps which have, along the upper edges thereof, lips coinciding with the recesses in the bottom panel full end flaps, and rear panel end flaps which overlie the other flaps and are secured thereto by single lines of adhesive extending along the edges of the front panel end flaps and up to the cover panel end flap lower edges or up onto the cover panel end flaps, depending upon whether or not the rear panel end flaps comprise breakaway tabs to be adhesively secured to the cover panel end flaps, as well as additional advantageous features, carton blanks and tubes for producing the same, and method of closing the carton ends, are all disclosed.

31 Claims, 17 Drawing Figures

ICE-CREAM CARTON, CARTON BLANK, AND METHOD OF ERECTING SAME

The present application is a continuation-in-part of my prior-filed copending application Ser. No. 866,890, filed May 23, 1986, now U.S. Pat. No. 4,712,730.

BACKGROUND OF INVENTION

1. Field of Invention

The Art of Packaging. Novel cartons of paperboard or like material, suitable for containing ice cream or other semi-solid material or the like, carton blanks therefor, carton tubes erected therefrom, carton tubes having one closed end and suitable for filling, closed and filled cartons comprising the ice cream of similar material contained or packaged therein, method of erecting and closing such cartons. 2. Prior Art Prior art cartons as represented by earlier U.S. Pat. Nos. 3,040,957 and 1,509,383 had numerous disadvantages, the shortcomings of which are discussed in Column 1 of issued U.S. Pat. No. 4,239,115. In this latter patent certain structures were provided which were in some ways improvements over preexisting cartons in the field but which, nevertheless, themselves suffer from certain disadvantages and shortcomings which the present invention is designed to eliminate and correct, among which shortcomings are the inability to adapt on carton erecting, filling, and closing equipment to even marginal changes in caliper or density of the paperboard material of construction, the necessity of modifying existing carton erecting, filling, and closing machine to facilitate employment of such cartons thereon involving very substantial changes in the equipment, in fact at least five (5) substantial changes in the preexisting equipment (as compared with only three (3) changes required for utilization of the cartons of the present invention on the same erecting, filling, and closing lines), and the tendency of the flaps in the carton of that earlier patent to become "contaminated" with adherent semi-solid ice cream or similar material during the process of filling and closing, which of necessity is performed in a sequence which enables the semi-solid material to interfere with entrance of side flap lips beneath the cover panel and also to collect between the various end-closure elements so as to cause machine failure and/or to interfere with their adequate placement and/or securement by adhesion one to another, especially when solid material such as nuts, raisins, or the like are present in the material being filled into the carton, with the result that the carton ends having an unseemly and/or bulging appearance, or are inadequately secured and accordingly involve an unacceptably high percentage of "leakers", especially when superior cartons having superior end closures are available for their replacement.

ADVANTAGES OF THE CARTON OF THE PRESENT INVENTION

Among the numerous advantages which characterize the carton of the present invention, and the carton blank and carton tube from which it is formed, are the following:

It is capable of construction of relatively low-caliper board and as economically as any carton on the market;

it is essentially leakproof;

it is capable of erection and filling and closing on rapidly-moving machinery at an acceptable rate for commercial employment;

it is capable of employment on less complex and existing carton erecting, filling, and closing equipment, in fact, only three additional air cylinders are required on existing carton-filling equipment as compared with five additional air cylinders, among other things, when compared with other recently-developed carton types;

it is sealed by the employement of adhesive in the simplest possible manner, namely, by the employment of a single adhesive line on the end flaps adjacent and parallel to the carton rear wall plus a small area of adhesive on the cover panel end flap adjacent the front wall of the carton for securing the corner posts on the cover panel front flap thereto, as compared with two full flue lines which have been required for formation of a square carton end in the most acceptable of the recently-developed cartons available for the same use;

in carton erecting, filling, and closing equipment, the carton bottom full end flap is at the trailing edge of the carton as it comes to the filling nozzle cut off, the first flap to closed, and is folded forwardly and inwardly, thereby enclosing all of the semi-solid ice cream or the like with which the carton is being filled into the carton itself, semi-solid material (with which the carton is being filled) which attaches itself to the said flap being infolded into the carton along with said flap;

the lip or extension along the top edge of the carton front panel end flap, which is infolded second, passes under the filling equipment cut off ahead of the bottom panel full end flap and is folded down into place with the bottom panel full end flap already folded in so that the lip passes between the bottom panel full end flap (through the corresponding recess provided therein) and the cover panel in clean condition and without adherence thereto of semi-solid material being filled into the carton from the filling nozzle cut off; and, finally, nuts, raisins, or like solid ingredients present in the semi-solid material being filled into the carton, when its unique members are folded in this unique sequence, are already inside of the carton due to the infolding of the bottom panel full end flap so that they do not interfere with the insertion of the carton front-panel end flap lip between the cover panel and the upper edge of the bottom panel full end flap or locate themselves externally of the bottom panel full end flap so as to prevent the carton front and rear panel end flaps from lying flat and in close juxtaposition thereagainst or interfere with adhesion of the carton rear panel end flap, the last to be folded in, to the underlying bottom full end flap and the overlying carton front wall end flap (which flap is overlapped by the rear panel end flap).

Another advantage of the carton of the invention is the provision of an optional securement feature, to be employed upon reclosing of the carton cover during use, which does not require the positioning of the securement feature elements in the "secure" position during erection, filling, or closing, but only after the carton cover is opened and for reclosure during use.

Still another optional but advantageous feature of the carton of the invention is the provision of inner rear corner supports, formed as extensions of the bottom panel end flaps along their rearwardly facing edges, to provide additional support in the closed carton at its then weakest points and provide an additional leakproof aspect.

A further optional but highly-advantageous feature of the carton of the invention is the provision of breakaway tabs at the upper ends of the rear panel end flaps which are adhesively secured to the carton cover panel end flaps, conveniently by a continuation or extension of the same lines of adhesive which secure the front and rear panel end flaps to each other and to the underlying bottom panel end flaps adjacent to the carton rear wall, and which breakaway tabs, together with the adjacent rearwardmost portions of the cover panel end flaps and the remaining segments of the upper portions of the rear panel end flaps, form a unique and stabilizing retuck tab feature of a carton of the invention, just as securement of the breakaway tab segments of the rear panel end flaps to the cover panel end flaps stabilizes the carton structure and minimizes "gapping" while the rear panel end flaps are still integral before the carton cover is opened and the breakaway tab segments are separated from the remaining upper portions of the rear wall end flaps along severance lines or lines of weakness provided to facilitate such separation.

Further advantages of the carton of the invention will be apparent to one skilled in the art and additional advantages will be obvious as the description proceeds.

OBJECTS OF THE INVENTION

It is an object of the present invention to provide improvements in the packaging of semi-solid materials such as ice cream and the like. It is a further object of the invention to provide a carton which is extremely simple to manufacture, erect, fill, and close about the materials to be packaged therein, and which has superior appearance at the square ends thereof and which is essentially leakproof. It is an additional object of the invention to provide an improved method for making, erecting, filling, and closing cartons of the class described. Other objects are to provide novel tube cartons which are end-fill cartons in which the one end can be formed and sealed without a mandrel prior to filling with selected content and the other end of which can also be sealed without a mandrel. Still a further object of the invention is to provide a package having improved openability and remarkably improved reclosability and which affords improved protection to the contents thereof after initial openings and reuse. A still further object is to provide novel carton blanks adapted to be converted into the carton tubes and cartons of the present invention which are produced from paperboard sheet stock and high speed cutting and squaring machines and which require minimal paperboard caliper and minimal stock waste in the cutting and squaring operation and accordingly a high degree of economy in raw material usage.

Still additional objects of the invention are to avoid the stated disadvantages of the prior art constructions and to obtain the advantages which have been stated in the foregoing section of the this application. Still further objects will become apparent hereinafter and others will be obvious to one skilled in the art to which this invention pertains.

DESCRIPTION OF THE PREFERRED EMBODIMENTS OF THE INVENTION

The invention in a preferred embodiment is illustrated by the accompanying drawings in which:

FIG. 4 is a partial view of the carton tube of FIG. 3 showing the inner end-wall forming flap folded in.

FIG. 9 is the same as FIG. 8 with the inner end-wall forming flap, being the carton bottom full end flap, folded in.

Figure 12:
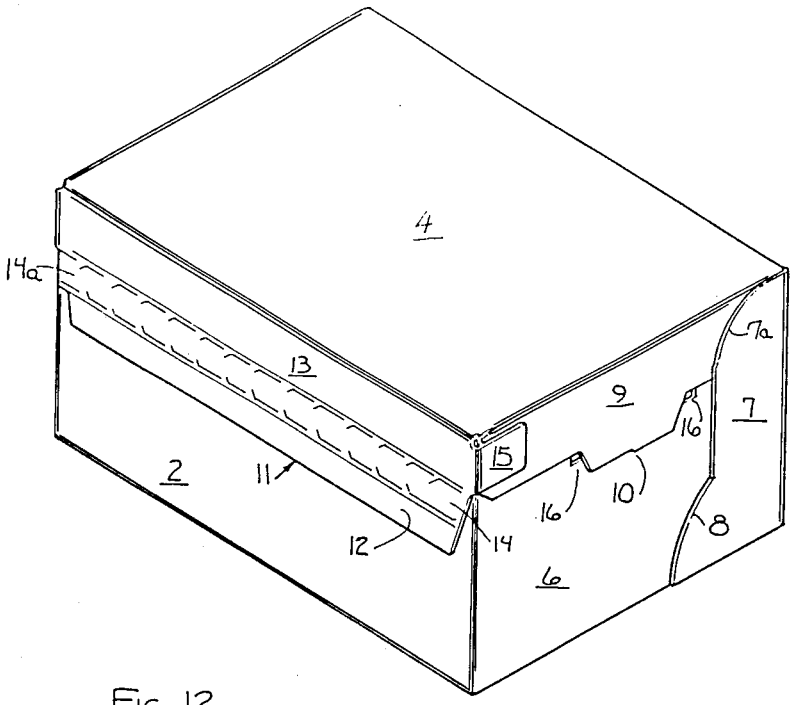
Figure 13:
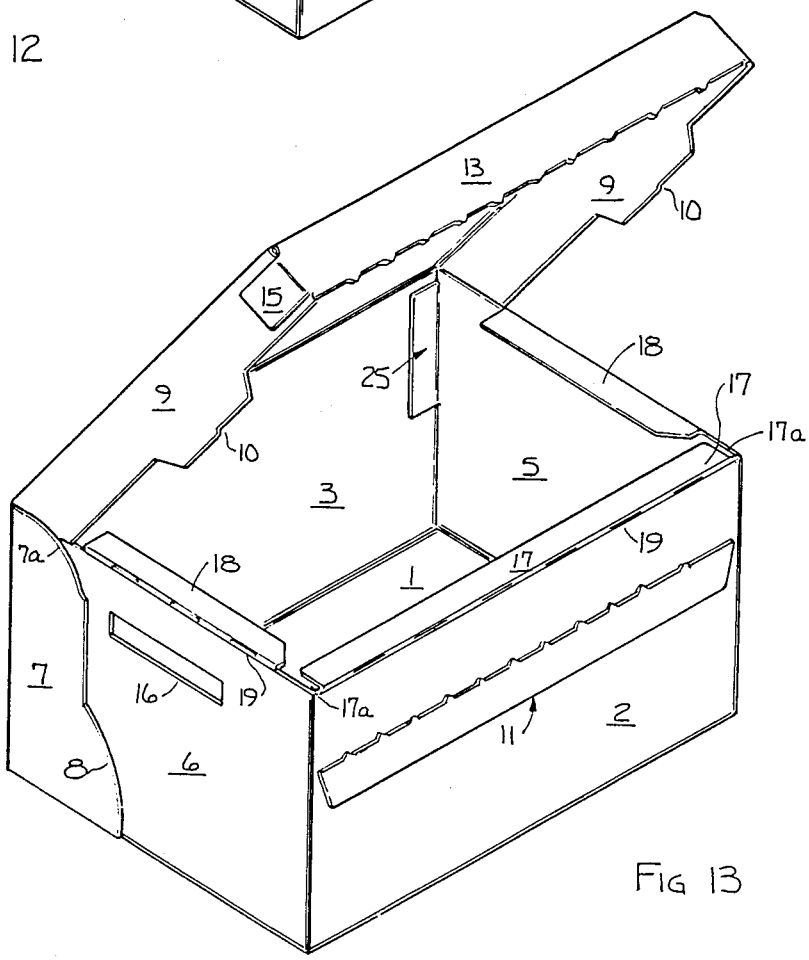

FIG. 12 is a isometric view showing the finished, filled, and closed carton or package, and FIG. 13 is an isometric view of the opened carton with the tear strip, inner plastic liner, and contents removed for purposes of showing the interior of the carton and its corner support means at the juncture of the rear and side walls thereof, the lips, and the relationship of the cover panel end flap tuck-in tab and its slit or slot securement means in the side of the carton.

Figure 11:
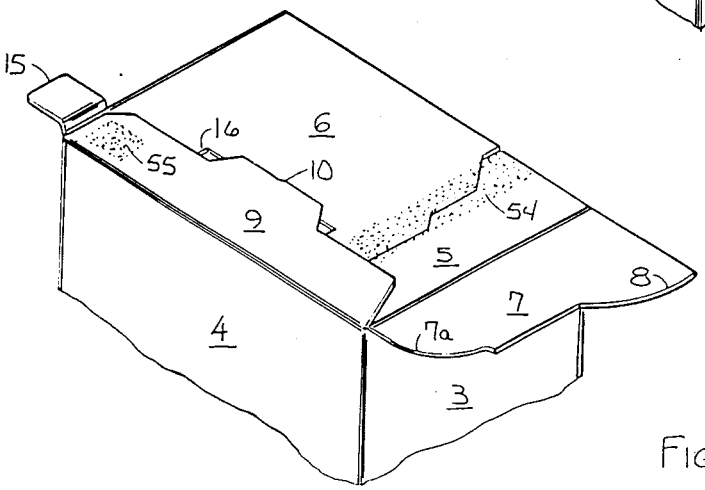
FIG. 11 is like FIG. 6, but at the other end of the carton after filling, showing the adhesive areas as applied to the folded-in end flaps.
Figure 14:
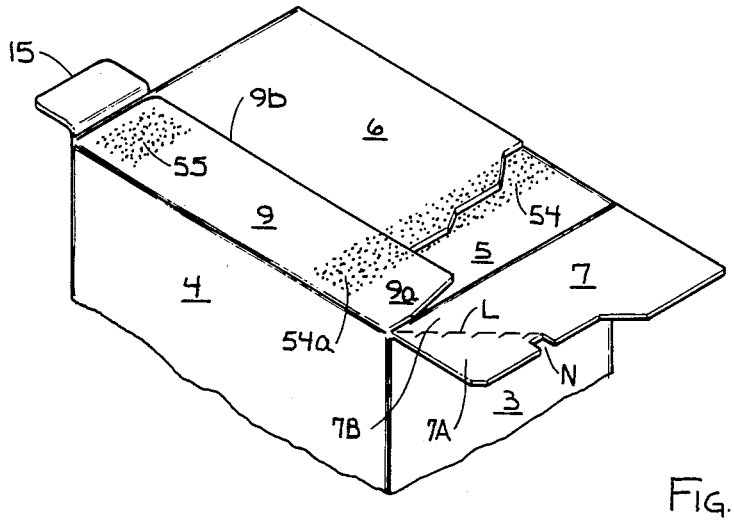
Figure 15:
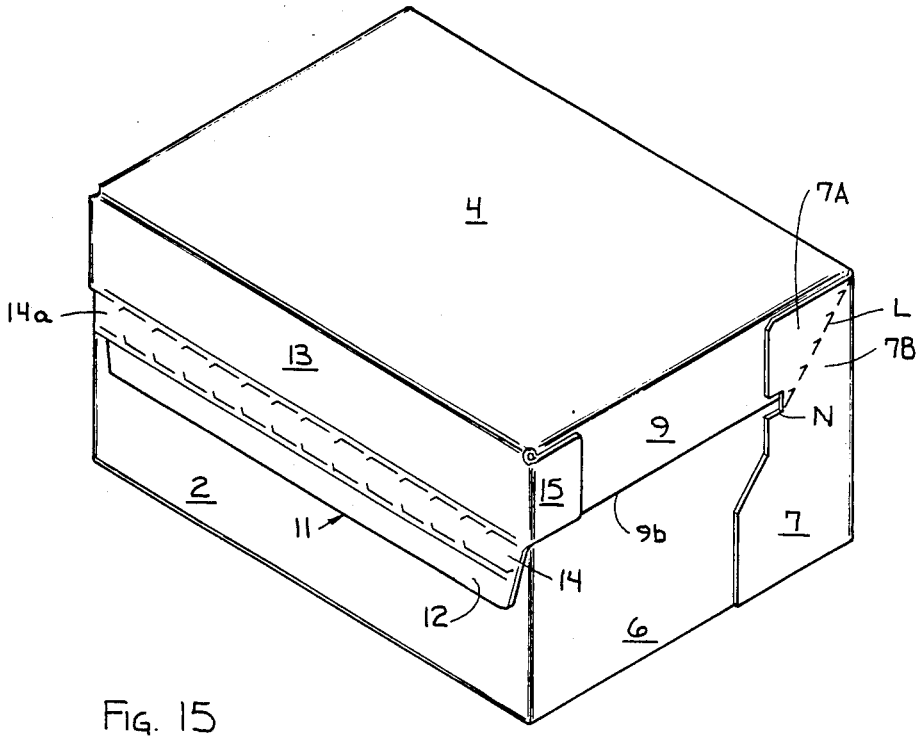
Figure 16:
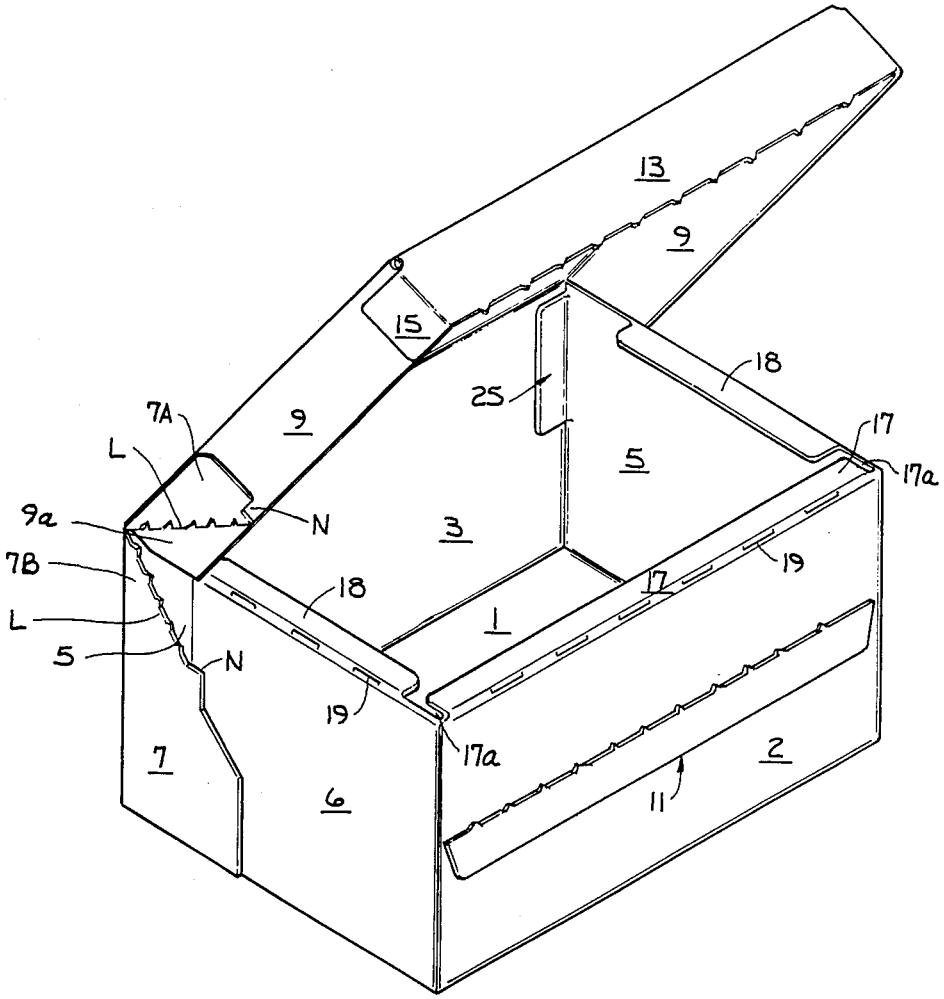
Figure 17:
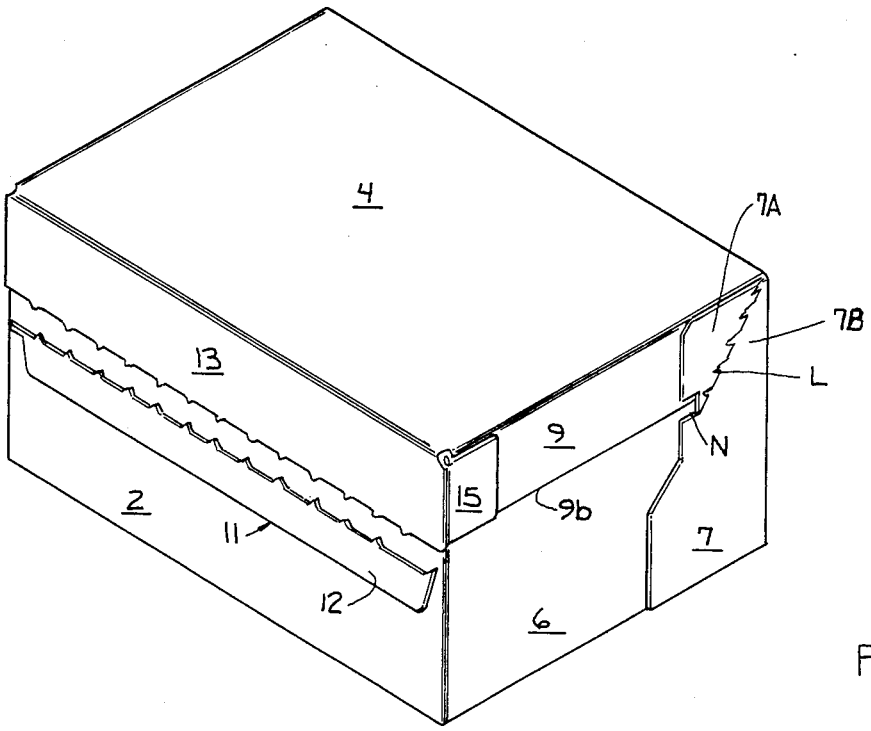

FIGS. 14, 15, 16, and 17 are isometric views of a further embodiment of the invention in which the upper portions of the carton rear wall end flaps are provided with breakaway tabs defined therein by lines of weakness or separation, which tabs are secured to underlying portions of the cover panel end flaps by adhesive, preferably provided as a continuation of the same single line of adhesive which secures the rear and front wall panel end flaps to each other and to the underlying bottom panel end flaps adjacent the carton rear wall (as best shown in FIG. 14, which is like FIG. 11, with adhesive areas indicated). The carton is shown with cover closed in FIG. 15, with the cover open and said breakway tabs torn away along said lines of weakness or separation, which occurs upon opening of the carton, and with retuck tabs at the rearwardmost portion of the cover panel end flaps in view (FIG. 16); and with the cover closed and the retuck tabs tucked or retucked back into the aperture, slit, or slot provided between the unsecured upper segment of the carton rear wall end flaps and the underlying front panel and bottom panel end flaps (FIG. 17).

SUMMARY OF THE INVENTION

The invention then, inter alia, comprises the following:

in an integral carton blank adapted to be erected into a carton, having a bottom panel, a front panel hingedly connected to one edge of said bottom panel, a rear panel hingedly connected to the opposite edge of said bottom panel, a cover panel hingedly connected to the opposite edge of said rear panel, and a cover panel front flap connected to said cover panel and adapted to overlap said front panel and to be releasably secured thereto in the erected carton, said bottom panel having end flaps hingedly connected thereto, said rear panel having end flaps hingedly connected thereto, said front panel having end flaps hingedly connected thereto, said cover panel having end flaps hingedly connected thereto, and said cover panel front flap having end posts hingedly connected thereto, said bottom panel, front panel, and rear panel end flaps being adapted to be folded in to form end walls in the erected carton, and said cover panel front flap end posts being adapted to overlie said cover panel end flaps and to be secured thereto in the erected carton to form a skirted cover, the improvement which comprises:

said bottom panel end flaps are adapted to be infolded so as to constitute the inner end walls of the erected carton, said front panel end flaps are adapted to overlie said said bottom panel end flaps in the erected carton, and said rear panel end flaps are adapted to overlie said bottom panel end flaps and to overlap said front panel end flaps in the erected carton, said bottom panel end flaps are full end flaps having an area adapted essentially to close an open end of a carton erected from said blank, said bottom panel end flaps have a recess along the major portion of the outer marginal edge thereof adapted to underlie the cover panel in the erected carton and of a depth corresponding generally to the thickness of the material of construction of said carton blank, said front panel end flaps are adapted to overlie a major portion of the area of the bottom panel end flaps in the erected carton and have, along the edge thereof adapted to be the upper edge thereof in the erected carton, a lip extending along the greater portion of the reach thereof and adapted to coincide with said recess in said outer marginal edge of said bottom panel full end flaps in a closed carton erected from said blank, and said rear panel end flaps being adapted to overlie a minor portion of the area of said bottom panel full end flaps and to overlap said front panel end flaps and to be secured thereto by single lines of adhesive extending from the bottom of the rearwardmost edges of said front panel end flaps along the edges thereof up to the cover panel end flap lower edges or up onto the cover panel end flaps, depending upon whether or not the rear panel end flaps comprise breakaway tabs to be adhesively secured to the cover panel end flaps; such a carton blank wherein said front panel end flaps have an opening therein adapted to mate with tuck-in-tabs provided on said cover panel end flaps in the erected carton and after the carton has been opened, and said cover panel end flaps are provided with tuck-in-tabs on the marginal edges thereof adapted to be the lower edges thereof in the erected carton, which tabs are adapted to engage said openings in said front panel end flaps upon reclosure of a carton erected from said blank for temporary securement of the cover in closed position during use; such a carton blank wherein said openings in said front panel end flaps are in the form of slits or slots adapted to receive and engage said tuck-in-tabs on said cover panel end flaps; such a carton blank wherein said front panel has a lip articulated thereto along the edge thereof adapted to be the upper edge in the erected carton, and is generally of the same length as said front panel upper edge, preferably except for a space left at each end of said lip, usually of approximately the thickness of the material of construction of said carton blank, to allow room for the thickness of the front top edge of said bottom panel full end flap upon erection of a carton from said blank; such a carton blank wherein said blank has adhered thereto a liner of sheetform plastic material which is adhesively secured to the upper portion of the said rear panel and extends approximately along the full width of said rear panel and said cover panel and is adhesively secured to said cover panel front flap; such a carton blank wherein the score lines between said cover panel front flap and said cover panel front flap corner posts are offset slightly outwardly with respect to the score lines between said cover panel end flaps and said cover panel to facilitate securement of said corner posts to the outer surfaces of said cover panel end flaps upon erection of a carton from said flank; such a carton blank wherein said bottom panel full end flaps have an elongated extension along the edges thereof adapted to be the rear edges thereof in the erected carton adjacent the edges thereof adapted to be the top edges in the erected carton for purposes of providing rear corner support in the erected carton; such a carton blank wherein the upper portion of each rear panel end flap has a downwardly and outwardly arcuate edge to facilitate insertion of a cover panel end flap therebehind upon reclosure of a carton erected from said blank during use; and such a carton blank wherein the lower portion of each rear panel end flap has a bulge with a downwardly and outwardly sloping arcuate edge near the lower marginal edge thereof.

Moreover, a carton tube formed from such an integral blank by folding the front panel back upon the bottom panel along the score line between said panels, by folding the cover panel along the score line between said cover panel and said rear panel so that said cover panel lies in juxtaposition to said front panel, and adhesively securing the lower portion of the cover panel front flap to said front panel; such a carton tube in flat folded condition; such a carton tube in squared-up condition; such a carton tube in squared-up condition and having one end closed by folded in and adhesively secured end flaps thereof; and such latter carton tube filled with content and closed at both ends by adhesively secured end flaps thereof.

Additionally, in a carton having a bottom panel, a front panel hingedly connected to on edge of said bottom panel, a rear panel hingedly connected to the opposite edge of said bottom panel, a cover panel hingedly connected to the opposite edge of said rear panel, and a cover panel front flap connected to said cover panel and overlapping said front panel and releasably secured thereto, said bottom panel having end flaps hingedly connected thereto, said rear panel having end flaps hingedly connected thereto, said front panel having end flaps hingedly connected thereto, said cover panel having end flaps hingedly connected thereto, and said cover panel front flap having end posts hingedly connected thereto, said bottom panel, front panel, and rear panel end flaps being folded in to form end walls, and said cover panel front flap end posts overlying said cover panel end flaps and secured thereto to form a skirted cover, the improvement which comprises:

said bottom panel end flaps are infolded to constitute the inner end walls, said front panel end flaps overlie said said bottom panel end flaps, and said rear panel end flaps overlie said bottom panel end flaps and overlap said front panel end flaps in the carton, said bottom panel end flaps are full end flaps having an area essentially closing an end of the carton, said bottom panel end flaps have recess along a major portion of the outer marginal edge thereof which underlies the cover panel and of a depth corresponding generally to the thickness of the material of construction of said carton, said front panel end flaps overlie a major portion of the area of the bottom panel end flaps and have, along the upper edge thereof, a lip extending along the greater portion of the reach thereof and coinciding with said recess in said outer marginal edge of said bottom panel full end flaps, and said rear panel end flaps overlie a minor portion of the area of said bottom panel full end flaps and overlap said front panel end flaps and are secured thereto by single lines of adhesive extending from the bottom of the rearwardmost edges of said front panel end flaps along the edges thereof and up to the cover panel end flap lower edges, or up onto the cover panel end flaps, depending upon whether or not the rear panel end flaps comprise breakaway tabs to be adhesively secured to the cover panel end flaps, such a carton wherein said front panel end flaps have an opening therein which is adapted to mate with a tuck-in-tab provided on said cover panel end flaps after the carton has been opened, and said cover panel end flaps are provided with tuck-in-tabs on the lower marginal edges thereof, which tabs are adapted to engage said openings in said front panel end flaps upon reclosure of the carton for temporary securement of the cover in closed position during use; such a carton wherein said openings in said front panel end flaps are in the form of slits or slots adapted to receive and engage said tuck-in-tabs on said cover panel end flaps, such a carton wherein said front panel has a lip articulated thereto along the upper edge thereof, which is generally of the same length as said front panel upper edge, preferably except for a space left at each end of said lip, usually of approximately the thickness of the material of construction of said carton, thus allowing room for the thickness of the top edge of said bottom panel full end flap; such a carton wherein said bottom panel full end flaps have an elongated extension along the edges thereof adjacent their top edges for purposes of providing rear corner support in and to further leakproof the carton; such a carton wherein the score lines between said cover panel front flap and said cover panel front flap corner posts are offset slightly outwardly with respect to the score lines between said cover panel end flaps and said cover panel; such a carton having a liner of sheetform plastic material which is adhesively secured to the upper portion of said rear panel and extends approximately along the full width of said rear panel and said cover panel and is adhesively secured to said cover panel front flap; such a carton wherein the upper portion of each rear panel end flap is unsecured and has a downwardly and outwardly sloping arcuate edge to facilitate insertion of a cover panel end flap therebehind upon reclosure of said carton during use, and such a carton wherein the lower portion of each rear panel end flap is secured and has a bulge with a downwardly and outwardly sloping arcuate edge near the lowermost marginal edge thereof.

Additionally, a method of closing an end of a carton tube erected from such a carton blank which comprises the steps of folding in said bottom panel full end flap, folding in said front panel end flap upon said bottom panel flap full end flap and inserting the lip thereof into said recess in the marginal edge of said bottom panel full end flap, folding in said cover panel end flap upon said bottom panel full end flap and said front panel end flap, applying adhesive to the front edge of said cover panel end flap or to the corner post on said cover panel front flap and along the edge of said front panel end flap and into contact with the adjacent area of said underlying bottom panel full end flap up to the lower edge of the cover panel end flap or up onto the cover panel end flap, depending upon whether or not the rear panel end flap comprises a breakaway tab to be adhesively secured to the cover panel end flap, and folding in the end post and the rear panel end flap to adhesively secure the same and complete the carton end; and such a method of closing an end of such a carton tube erected from a carton blank which comprises the steps of folding in said bottom panel full end flap, until it contacts the end of said lip at the upper edge of said front panel and lies in close juxtaposition thereto, folding in said front panel end flap upon said bottom panel full end flap and inserting the lip thereof into said recess in the marginal edge of said bottom panel full end flap, folding in said cover panel end flap upon said bottom panel full end flap and said front panel end flap, applying adhesive to the front edge of said cover panel end flap or to the corner post on said cover panel front flap and along the edge of said front panel end flap and into contact with the adjacent area of said underlying bottom panel full end flap up to the lower edge of the cover panel end flap, and folding in the end post and the rear panel end flap to adhesively secure the same and complete the carton end; and such a method wherein said carton blank also comprises an elongated extension along the edges of said bottom panel full end flaps which are adapted to be the rear edges thereof in the erected carton adjacent the edges thereof adapted to be the top edges in the erected carton, and wherein said bottom panel full end flap elongated extension is folded in along with said bottom panel full end flap and caused to lie against the carton rear panel thereby to provide rear corner support in the erected carton.

Figure 1:
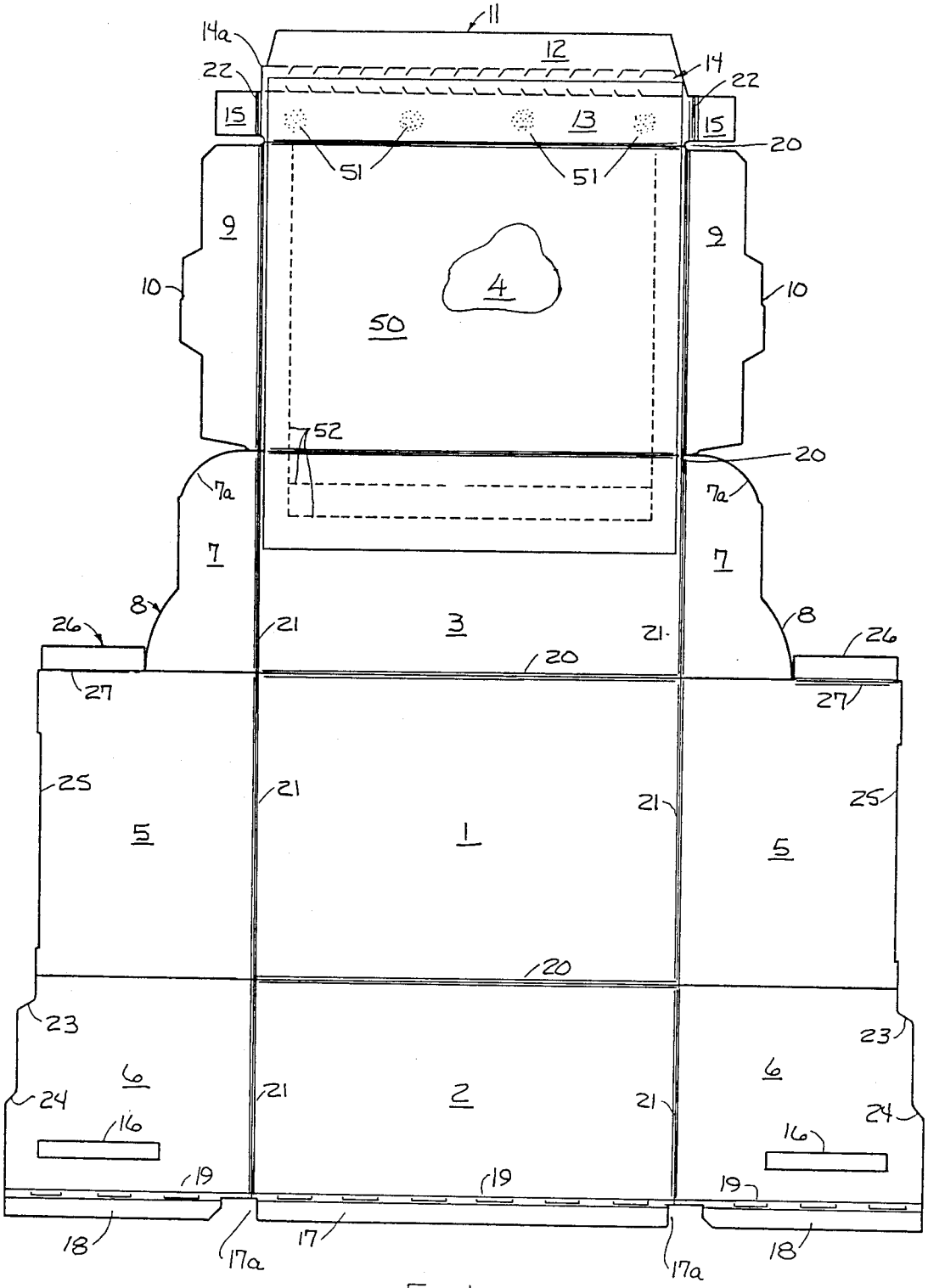
FIG. 1 is a plan view of a blank cut and scored for assembling a carton having the novel features according to the invention.
Figure 2:
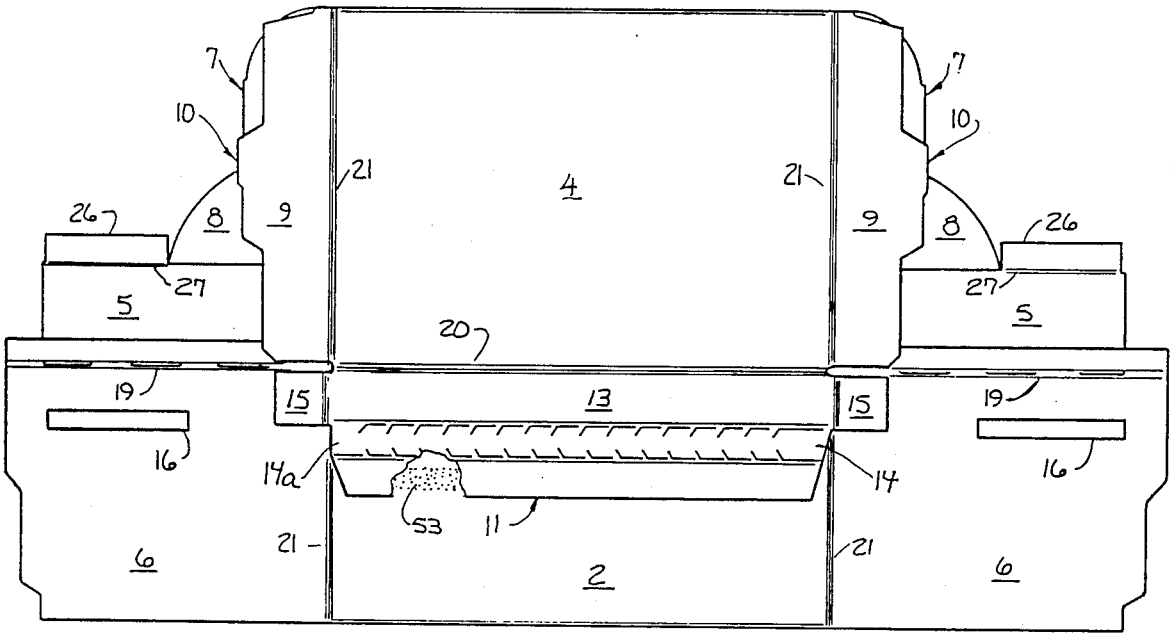
FIG. 2 is a plan view of a collapsed carton tube formed from the integral blank of FIG. 1 partially cut away to show the adhesive between the front panel and the cover panel front flap.
Figure 3:
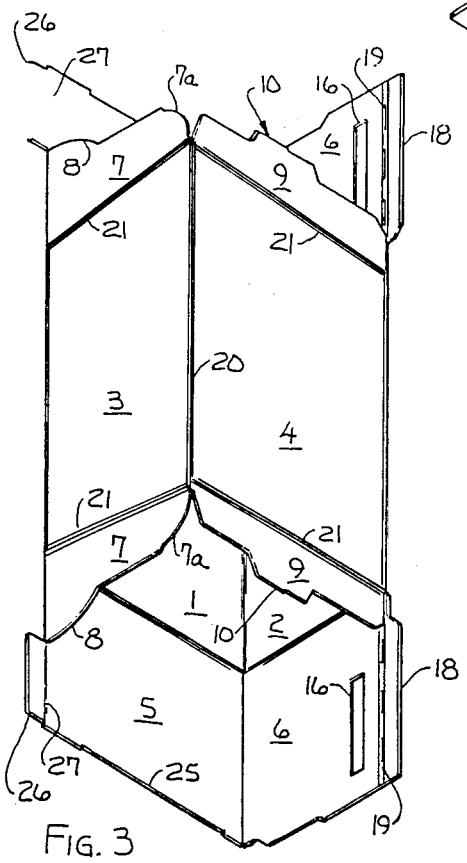
FIG. 3 is an isometric reduced-size view of the collapsed carton tube of FIG. 2 opened up into a tube.

In addition, the invention includes novel cartons as described in the foregoing wherein upper segments of the carton rear wall panel end flaps are adhesively secured to underlying cover panel end flaps, preferably by a mere continuation of the single line of adhesive used to secure the front and rear wall panel end flaps to each other and to the underlying bottom panel end flaps, and wherein breakaway tabs are provided as a feature of the carton at the upper portions of the rear wall panel end flaps, said breakaway tabs being upper and adhesively-secured segments of said rear wall panel end flaps defined by means of lines of separation or weakness provided therein, so that the breakaway tabs separate cleanly along said lines of weakness upon opening of the carton and preferably, together with the adjacent rearwardmost segments of the cover panel end flaps, to which the breakaway tabs remain attached upon openings the carton, provide a convenient means for tucking or retucking of the said rearwardmost portion of the cover panel end flaps (as a tuck-tab or retuck-tab) into the slot existing between the remaining segments of the upper portions of the rear wall panel end flaps and the underlying bottom panel end flaps, thereby to stabilize the carton upon reclosure and to assist in preventing "gapping" along the cover panel end flaps lower margins, just as this feature provides the same stabilization prior to opening of the carton and before the breakaway tabs are separated along said lines of weakness from the remaining upper portions of said rear wall panel end flaps. Carton blanks comprising such breakaway tab features, and carton tubes erected from such blanks en route to the completed cartons, from which the breakaway-tab comprising cartons are erected, and which blanks and tubes are otherwise except for said breakaway feature (shown clearly in FIGS. 14–17) as illustrated in FIGS. 1–11, especially FIGS. 1–3, are also comprised by the invention, whether said carton tube is flat folded, squared-up, squared-up with one end closed and having its end flaps folded in and adhesively secured, or squared-up and closed by folded-in and adhesively secured end flaps at both ends and filled with desired content.

Further, such a carton wherein the upper portion of each rear panel end flap comprises a breakaway tab, defined in said upper portion of said rear panel end flap by a line of weakness, which breakaway tab is adhesively secured to an underlying portion of the carton cover panel end flap; and especially such a carton wherein said adhesive is provided as an extension or continuation of the single line of adhesive whereby the front and rear panel end flaps are secured together, and particularly such a carton wherein the rearwardmost portion of each of the cover panel end flaps is not adhesively secured to the adjacent rear panel end flap but remains attached to and adjacent the breakaway tab thereof upon opening of the carton, thereby providing a retuck tab adapted to be reinserted in the recess behind the remaining and unsecured upper portion of the rear panel end flap for stabilization of the carton upon reclosing of the same. Finally, such a carton blank as previously summarized wherein the upper portion of each rear panel end flap comprises a breakaway tab, defined in said upper portion of said rear panel end flap by a line of weakness, which breakaway tab is adapted to be adhesively secured to an underlying portion of a carton cover panel end flap, and such a method as previously summarized wherein the carton blank and carton tube comprise breakaway tabs, defined in the upper portions of said rear panel end flaps by lines of weakness, wherein adhesive is applied up onto the cover panel end flaps in a location adapted to underlie the said breakaway tabs upon folding in of said carton rear wall panel end flaps, and wherein the said breakaway tabs are secured to underlying portions of the cover panel end flaps.

BRIEF DESCRIPTION OF THE INVENTION

The invention has already been briefly described in the foregoing.

DETAILED DESCRIPTION OF THE INVENTION WITH SPECIFIC REFERENCE TO THE DRAWINGS

Reference is now made to the accompanying drawings for a better understanding of the invention, wherein all the parts are numbered and wherein the same numbers are used to refer to corresponding parts throughout, and wherein areas having an adhesive applied thereto are indicated by stippled shading or dotted lines where appropriate.

In a preferred form, the carton of the invention may be constructed from an integral blank, as illustrated in FIG. 1, and comprises a bottom panel 1, front panel 2, rear panel 3, and cover panel 4, hingedly connected to each other. Articulated to the side edges of the said panels along score lines are end-wall forming flaps 5, 6, and 7. Articulated to the side edges of cover panel 4 along score lines are cover panel end flaps 9. Articulated to the edge of the cover panel 4 adapted to be the front edge in the erected carton is cover panel front flap 11 comprising adhesive panel 12 and top panel 13 separated by tear strip 14, having a graspable portion 14a. Articulated to the side edges of cover panel front flap top panel 13 are corner posts, flaps, or extensions 15, adapted to be secured to the cover panel end flaps 9 to form with the cover panel 4 a skirted carton cover.

The score lines along which the panels 1, 2, 3, and 4 are articulated to their end flaps 5, 6, 7, and 9 are identified by the number 21 and these score lines are arranged with only minimal offsets so as to constitute an essentially continuous line. However, corner posts, flaps, or extensions 15 are articulated to the cover panel front flap top panel 13 along score lines 22 which are slightly outwardly offset from vertical score lines 21, approximately the thickness of the caliper of the material of construction employed, generally paperboard or the like, to enable corner posts, flaps, or extensions 15 to lie flat against the outside of cover panel end flaps 9 and to be adhered thereto without any gap between end flaps 9 and top panel 13 at the juncture thereof. The various panels are articulated to each other along horizontal score lines 20, as are cover panel 4 and cover panel front flap 11.

Rear panel end flaps 7 as shown are adapted to comprise a minor portion of the area at the carton end upon closing of the same, whereas front panel end flaps 6 are adapted to comprise a major portion of the area of the carton end upon closing of the same. The portion of rear panel end flaps 7 at the section thereof 7a adapted to be the top portion thereof in the erected carton are arcuately downwardly curved so as to be adapted to conveniently receive the end portions of the cover panel end flaps 9 upon erection and closing of a carton from the said blank of FIG. 1. The bottom portions of end flaps 7, as shown, comprise an outwardly extending arcuate section or bulge 8 for purposes of conveniently overlapping front panel end flap 6 at the edge thereof adapted to be the lower edge in the erected carton upon erection and closing of a carton from said blank.

Secured on the inner surface of the carton blank is a liner of clear plastic sheetform material 50 of polyethylene or the like, which extends approximately along the full width of said rear panel 3 and cover panel 4 and is adhesively secured to the upper portion of rear panel 3 along dotted adhesive lines 52 in spaced relation to its edges and, at the portion thereof overlapping front flap top panel 13, by adhesive area 51. Although as shown sheet 50 extends only up to scorelines 21, it may overlie them somewhat and such may be found advantageous in a particular case. In either case, it overlies lips 17 and 18 upon reclosure of a carton formed from said blank, although it may either overlie or underlie lips 18 upon initial erection of a carton from said blank.

At the extremities of front panel 2 and front panel end flaps 6 adapted to be the upper extremities thereof in the erected carton, are located lips 17 and 18, respectively, articulated to their respective panels and flaps along score lines, as shown along skip-cut score line 19.

As will be noted, front panel lip 17 is articulated to front panel 2 along score line 19, at the edge of front panel 2 which is adapted to be the upper edge thereof in the erected carton, and said lip 17 is of substantially the same length as said front panel edge except for a space 17*a* left at each end of said lip 17 of approximately the thickness of the material of construction of said carton blank to allow room for the thickness of the top front edge of the bottom panel full end flap 5 upon erection of a carton from said blank. In actual practice, upon folding in the flaps at the carton end in the proper sequence, the front top edge of the bottom panel full end flap 5, upon being infolded to close a carton open end as shown in FIG. 3 and following, will enter the space 17*a* at the end of front panel lip 17 and abut the marginal edge of lip 17, which thereby acts as a stop to prevent excessive inward movement of bottom panel full end flap 5 upon closing either end of the carton, a significant and advantageous feature, especially since bottom panel full end flap 5 is the first to be infolded upon closing either carton end and covers an area essentially equal to the cross section of the carton, or carton tube before closing the ends thereof, at both ends.

Also as shown, front panel end flaps 6 have steps 23 and 24 in the marginal edges thereof, to assist in their coverage of end flaps 5 and in their adhesive securement thereto as a part of the carton end.

Referring now to FIG. 2, this FIG is partially cut away to show adhesive 53 securing front panel 2 to panel 12 of cover panel front flap 11, the carton being otherwise in the form of a flat-folded tube and secured to itself along the usual so-called "manufacturer's joint". It is quite immaterial whether the adhesive for forming this joint is initially provided on the inside of adhesive panel 12 or on the outside of carton front panel 2 and the adhesive 53 will accordingly be supplied on whichever panel is found most convenient by the manufacturer.

FIG. 3 shows the erected carton tube, squared up from the flat-folded tube of FIG. 2, but in reduced scale with respect to the other FIG of the drawings, which are approximately one-half scale. From this isometric view, all of the previously described elements are visible except those on the carton front panel 2 and the cover panel front flap 11.

Figure 4:
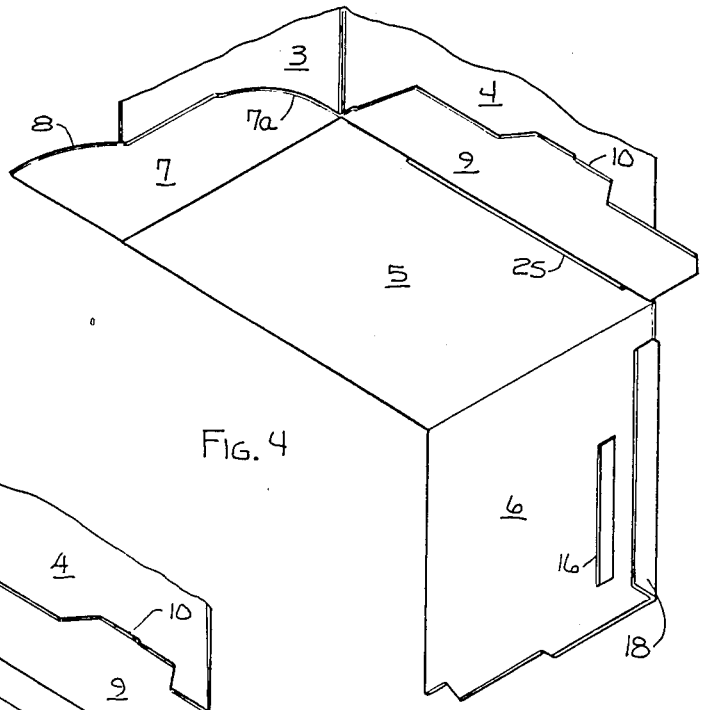

FIG. 4 shows the first step involved in the sequence of folds to close one end of the carton tube of FIG. 3 in which end flap 5, which is the full end flap attached to bottom panel 1, is folded in first. It is to be noted that the entire carton end is now essentially closed by bottom panel full end flap 5 with the exception of recess 25 at the top thereof adjacent to the underside of cover panel 4 at approximately the juncture of cover panel 4 and its end flap 9.

Figure 5:
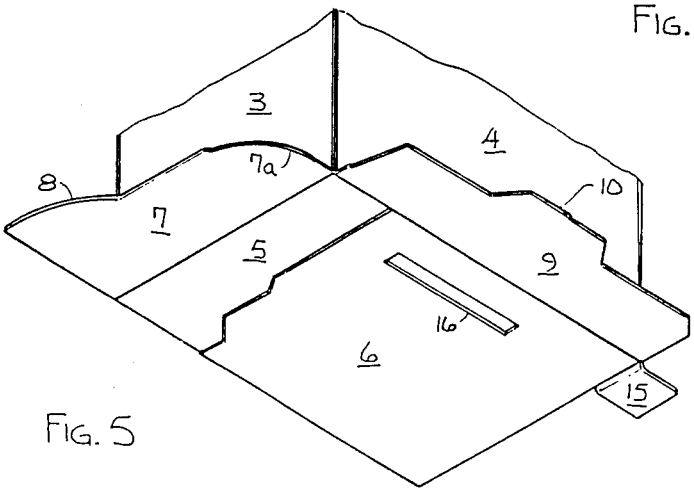
FIG. 5 is a partial view of the carton tube of FIG. 3 with the inner end-wall forming flap folded in and the front panel end flap folded over into juxtaposition therewith.

FIG. 5 shows the second step in the sequence of end-wall formation with front panel end flap 6 folded over into surface-to-surface juxtaposition with underlying carton bottom full end flap 5. The other end-forming flaps have not yet been folded in and remain extended along with corner post flap or extension 15.

Figure 6:
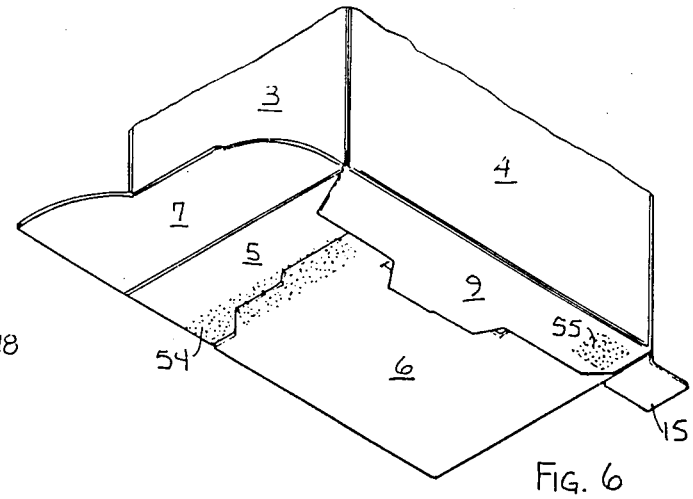
FIG. 6 is a further partial view of the carton tube of FIG. 3 showing the application of hot-melt adhesive at the junction between the inner end-wall forming flap and the front panel end flap and on the front corner of the overlying cover panel end flap.

FIG. 6 shows all of the end-forming flaps of the carton in closed position with the exception of rear panel end flap 7 and corner post flap or extension 15, with a strip of hot-melt adhesive having been laid in place by the usual applicator from the carton bottom up to the edge of cover panel end flap 9 along the marginal edge of front panel end flap 6 so that some of the adhesive is present on end flap 6, some on bottom panel full end flap 5, and some seals the marginal edge of flap 6 to and against flap 5. At this point the stage is set for the infolding of rear panel end flap 7. A hot melt adhesive area has also been spotted at the upper right-hand corner of the carton upon the front corner of cover panel end flap 9 preparatory to the infolding of corner post, flap, or extension 15 thereupon for adherence thereto.

Figure 7:
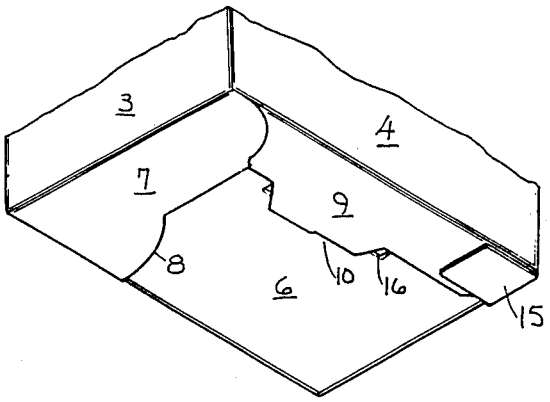
FIG. 7 is a similar view in which all of the endforming flaps of the carton are folded in and secured and in which the cover panel end flap tuck-in tab overlies its slit or slot securing means and in which the upper portion of the rear panel end flap overlies the rear portion of the cover panel end flap.

FIG. 7 shows the closed and sealed end of the carton tube with the upper unsecured and arcuate edge of rear panel end flap 7 overlapping the rear end of cover panel end flap 9 and the front end of cover panel end flap 9 being secured via corner post or extension 15 to cover panel front flap 11 thereby to form a skirted cover (so far at only the one end of the carton, however).

Figure 8:
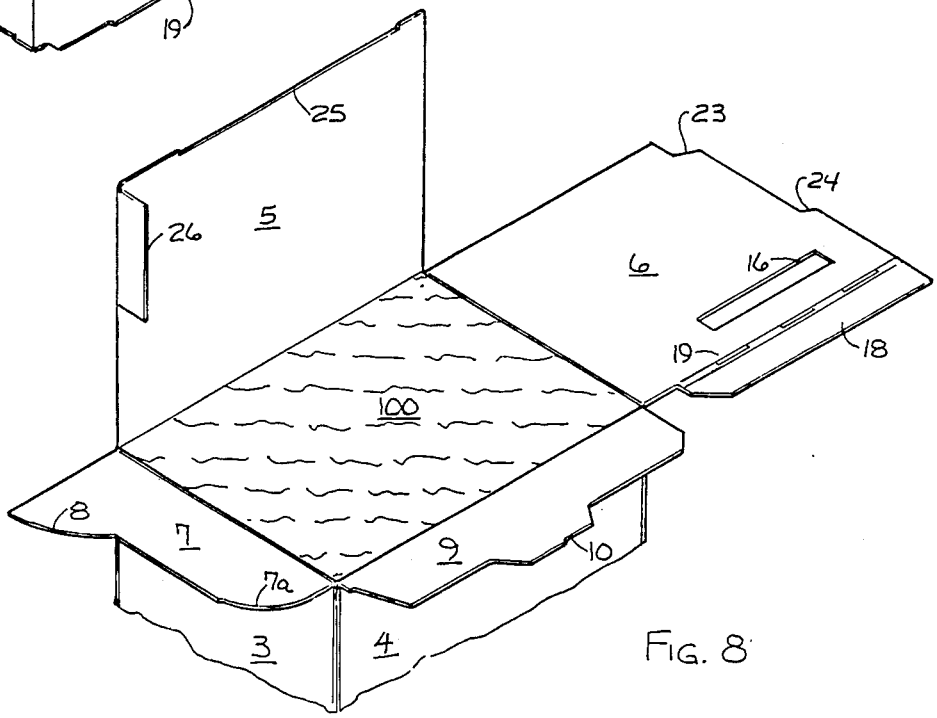
FIG. 8 is a partial view of a carton tube of FIG. 3 having its bottom end closed as in FIG. 7 with all end flaps folded back except bottom panel full end flap showing the interior of the carton at approximately the filling nozzle cut off position after just having been filled.

FIG. 8 shows the carton tube, after closing and sealing the one end as in FIG. 7, inverted as it then must be for filling. In this condition, with all of the flaps outwardly extending except bottom panel full end flap 5, the carton tube, closed at the one end, comes under the filling nozzle, which is inserted into the cavity of the carton tube, and which cuts off the filling operation just short of the upwardly-extending bottom panel full end flap 5, leaving the carton tube filled with semi-solid ice cream or the like 100 and with bottom panel full end flap 5 still in extended position and ready to be closed down upon the mass of semi-solid ice cream 100 or other similar material, at this point contained within the carton cavity.

Figure 9:
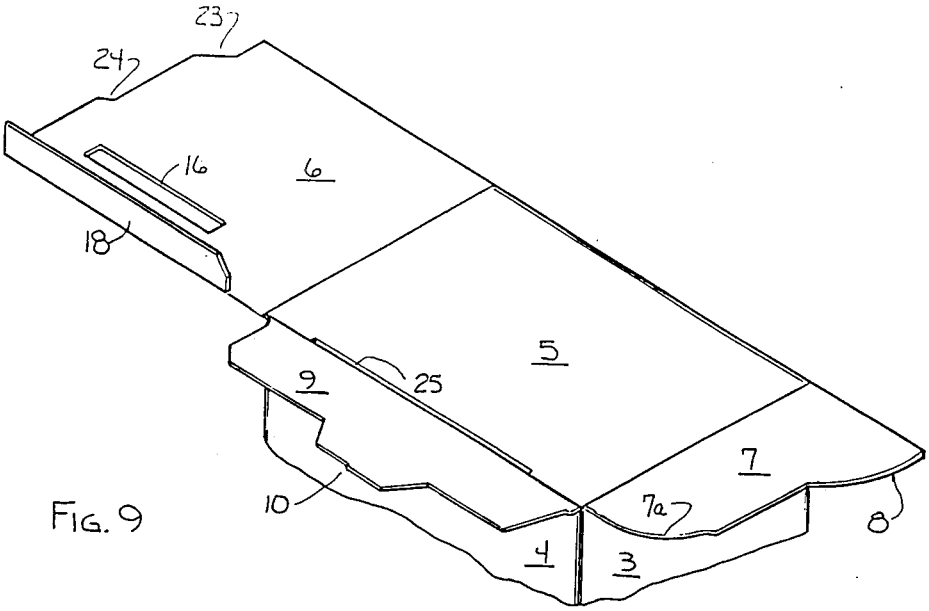

FIG. 9 is an isometric view of the carton end shown in FIG. 8 but with the bottom panel end flap 5 now closed down upon the mass of semi-solid ice cream or the like contained within the carton cavity. The other end-forming flaps remaining outwardly extended.

Figure 10:
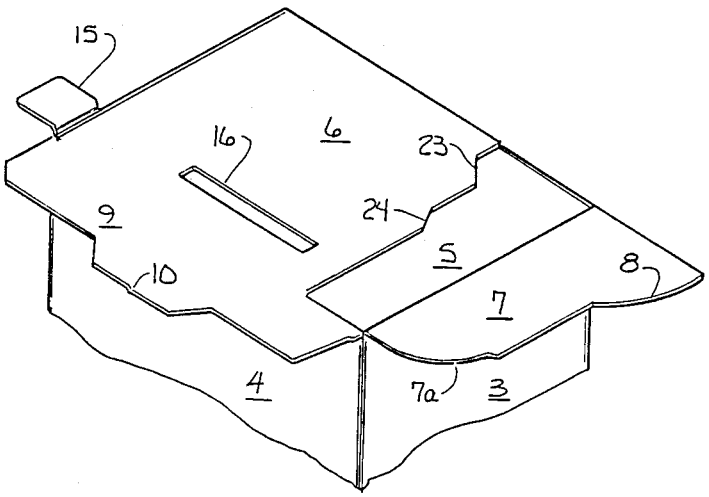
FIG. 10 is like FIG. 5, but at the other end of the carton after filling.

FIG. 10 is a further isometric view of the same carton end at a further stage in the closing sequence. FIG. 10 is like FIG. 5 in that the front wall panel end flap 6 has now been folded down into flat surface-to-surface contact and juxtaposition with respect to underlying full end flap 5, ready for sealing thereto by the application of hot melt adhesive after the infolding of cover panel end flap 9.

FIG. 11 is another isometric view of the same carton end, like FIG. 6, this time after the infolding of cover panel end flap 9 into surface to surface contact with bottom panel full end flap 5 and overlying front panel end flap 6 and the application of adhesive strip 54 and area 55, and just before infolding of rear panel end flap 7 and corner post 15 upon their respective adhesive areas.

As will be apparent to one skilled in the art, the adhesive area 55 may be deposited upon the front upper corner of cover panel end flap 9 adjacent corner post or extension 15 simultaneously or concurrently with deposit of adhesive strip 54, whereafter it is a matter of choice and convenience whether rear panel end flap 7 or corner post 15 is closed upon the deposited adhesive first or last, or whether both are closed upon said deposited adhesive simultaneously or concurrently. Of course, the adhesive area may be deposited upon corner post 15 rather than end flap 9 if for some reason found more convenient in practice.

In FIG. 11, the tuck-in-tab 10 at the lower marginal edge of cover panel end flap 9 overlies its securement means 16 in the form of a slit or slot and, when inserted thereinto during use, in spring-biased outwardly into intimate contact therewith along the lower and innermost edges thereof. Such bias will continue upon opening of the carton and upon reclosing it during the process of emptying the same and further use thereof until the tuck-in-tab loses its springlike characteristics.

FIG. 12 shows the erected, filled, and closed carton or package ready for opening, removing content, and reclosing during use. Tuck-in-tab 10 still overlies its cooperating securement means in the form of slit or slot 16, as will be seen protruding from the edges of tuck-in tab 10 in front panel end flap 6. The rear area of cover panel end flap 9 is secured beneath the upper portion *7a* of rear panel end flap 7, which upper portion *7a* has not been secured to underlying cover panel end flap 9. This upper portion *7a* is advantage outwardly arcuately curved for reinsertion of cover panel end flap 9 thereinto upon reclosing of the carton during use. The bottom of rear wall end flap 7 is advantageously outwardly bulged at 8, this marginal edge of end flap 7 completely and adequately covering the line of adhesive application lying therebeneath. Corner post, flap, or extension 15 is shown adhered to the forward edge of cover panel end flap 9, thereby completing the skirted cover.

When the carton is opened during use, the tear strip is removed by firmly grasping graspable portion 14*a* and removing tear strip 14 from the front of the carton and lifting the cover, thereby allowing ready access to its contents. Upon opening and reclosing, end flaps 9 slip readily into the unsecured upper portions *7a* of rear panel end flaps 7 and tuck-in tabs 10 at the lower marginal edges of cover panel end flaps 9 slip readily into securing means 16 in the form of slit or slot in front panel end flap 6.

FIG. 13 shows the carton with tear strip 14 and clear plastic sheet 50 removed and emptied of contents for purposes of better illustrating the subject matter of the invention. All of the elements previously described are apparent from FIG. 13, including lips 17, 18, and 18, cover panel end flaps 9 with the tuck-in-tabs 10, and front panel end flaps 6 with their securing means in the form of slits or slots 16 adapted to receive the tuck-in-tabs 10 for securement thereof upon reclosure of the carton during use. As will be noted, spaces 17*a*, left at both ends of front panel lip 17, allow the marginal edges at both ends of lip 17 to lie in close and abutting relationship with the top front edges of bottom panel full end flap 5, which is the full end flap first folded in, said marginal edges of lip 17 having provided a stop for said end flap 5 upon infolding of the same and now, in the erected carton, lying in close proximity to the upper front edges of said end flaps 5, thereby providing a further leakproof aspect of the carton of this invention at this important corners thereof.

Also apparent from FIG. 13 are the extensions 25 on bottom panel full end flap 5 which are an optional feature but which are here shown at the juncture between rear panel 3 and bottom panel full end flap 5 to provide additional support and leakprooofness at this joint at what is generally considered one of the weakest areas of any ice-cream or similar carton construction. Rear panel end flap 7 is again shown as fully covering the hot-melt adhesive line therebeneath and, with its inwardly and downwardly arcuate upper section *7a* and its outwardly arcuately extending section 8 adjacent the bottom edge of front panel end flap 6, provides a functional but eye-pleasing cover to the single line of adhesive employed for securing underlying bottom panel end flap 5 to overlying front panel end flap 5 along its marginal edge, thereby substantially preventing leaking by wicking or otherwise along the same. The adhesive of course also secures the outermost overlying end flap, which is the rear panel end flap 7 just described as overlying all of the other end-forming flaps and providing the outermost cover for the line of adhesive securing the same together, to end flaps 5 and 6, while at the same time providing an unsecured upper portion *7a* for ready access of one end of the cover panel end flap 9 thereinto upon reclosure of the carton during use and which, along with the reclosure securement feature comprising tuck-in-tabs 10 and cooperating securement means in the form of slit or slot 16, provide a stable secure carton which is also relatively securely reclosable and securable during use albeit having a pleasing outward appearance.

From FIGS. 14–17 will be seen a further embodiment of the invention in which the upper portions of rear wall panel end flaps 7 comprise breakaway tabs 7A, such break-away tabs being defined in flaps 7 by lines of weakness or separation L which separate them from the upper unsecured segments 7B of rear wall panel end flaps 7. This break-away flap feature involves adhesive securement of break-away flaps 7A to the underlying portions of cover panel end flaps 9 by a dollop of adhesive 54*a*, preferably provided by merely extending the single lines of adhesive 54, employed to secure the carton end flaps to each other, up onto the cover panel end flaps 9 before closing and securing of rear wall panel end flaps 7 to front wall panel end flaps 6 and underlying bottom panel end flaps 5 and preferably but not necessarily also before closing and securing end posts 15 to cover panel end flaps 9. Then, upon closing rear wall panel end flaps 7 upon their underlying end flaps 5 and 6, the upper segments 7A thereof are also secured to underlying portions of cover panel end flaps 9 by means of the adhesive 54*a* provided thereon. This feature adds stability to the carton and minimizes "gapping" along the lower or bottom edges 9*b* of cover panel end flaps 9, both before opening of the carton and after opening and reclosing of the carton. Preferably but not necessarily rear panel end flaps 7 are provided with notch N as shown to avoid unnecessary adhesive bonding at the lowermost junture of breakaway tabs 7A with the adjacent upper portions 7B of end flaps 51 on the other side of lines of weakness L, thus to facilitate more ready breaking away of breakaway tabs 7A at these junctures.

FIG. 14 shows the layout of the end flaps and adhesive before final closing and securement of the rear wall panel end flaps 7 and corner or end posts 15 to and upon the underlying carton end-forming members 5, 6, and 9.

FIG. 15 shows the closed carton embodying the break-away feature.

FIG. 16 shows the partially-opened carton with the breakaway tab 7A, torn from the remaining portions 7B at the upper ends of rear wall panel end flaps 7, secured adhesively to underlying portions of cover panel end flaps 9 and with residual tuck-tab portions 9a at the rearwardmost ends said underlying cover panel end flaps 9 ready and adapted to be reinserted, tucked, or retucked into the aperture provided between the unsecured remaining upper portions 7B of rear wall panel end flaps 7 and underlying bottom panel end flaps 5.

FIG. 17 shows the opened and reclosed carton embodying this breakaway tab feature, with tuck-in tabs 9a reinserted or tucked or retucked into the apertures provided by the remaining and unsecured portion 7B of rear wall panel end flaps 7 and the underlying bottom panel end flaps 5.

From these FIGS. 14–17 will be seen and understood the further breakaway tab feature of the invention, comprising also a residual tuck-tab aspect, which permits a further stabilization of the carton of the invention, especially the cover panel end flaps thereof, should this be desired. The line of weakness or separation may take any form conventional in the art for such lines of weakness or separation, including cut scores, skip scores, perforations, or the like.

From the foregoing it is seen that, by the present invention, an economical and conveniently-erected and sealed carton of sufficient durability for frequent opening and reclosing is produced, having a particularly advantageously designed end structure which facilitates its closing and sealing without usual disadvantages and complications and without the employment of flat-surface mandrels or the like, and which carton is produced from an integral blank through the intermediate stages of a flat-folded carton tube, squared up carton tube, and closed end carton tube suitable for filling and then closing. By employment of the outside corner post with its offset score line, the unique structure on the end closure panels, the unique end closure panels themselves and the arrangement thereof, and the unique arrangement of the lips located along the top edges of the carton front panel end flaps in combination with cooperating recess provided at the marginal edge of the carton bottom full end flaps which become the inner end flaps upon filling and closing of the carton, as well as the optional but preferable inner rear corner supports formed as extensions on the bottom panel end flaps along their edges which will be rearwardly facing in the erected carton, and together with the optional reclosure securement feature which does not of necessity require engagement into the "secured" position during erection and filling of the carton, as well as all of the other cooperating elements fully and completely set forth in the foregoing, and the unique employment of the front panel upper lip ends first as stops and then as closely nesting abutments for the top front edges of the bottom panel full end flaps to produce tightly-fitting front corners, and preferably including the inner plastic liner and breakaway tab and "retuck" tab features, all of the desirable objectives of the present invention are obtained, including those set forth in the foregoing under the heading ADVANTAGES OF THE CARTON OF THE PRESENT INVENTION and under OBJECTS OF THE INVENTION, are attained.

Although the invention as been described primarily as it would be practiced when a hot-melt adhesive is applied to the carton blank in the process of erection of the same, as is now common in the art, it is to be understood that other types and forms of adhesive and other means of applying the adhesive to effect sealing of the carton may be employed, such as pre-applied heat-sealable adhesive, or the like, provided only that the necessary adhesion be secured at the critical points of the carton of the present invention, namely, between the cover panel front flap and the carton front panel for purposes of forming the necessary tube, between the cover front flap end post and the cover panel end flap for purposes of forming a cover "skirt", and between the carton bottom full end flap and the overlying front panel end flap and the further overlying carton rear panel end flap.

Although, as shown in the drawings and as described in the foregoing, the cover panel front flap comprises a tear strip means and a lower adhered panel for securement to the carton front panel, a simple releasably-secured adhesive panel whereby said cover front flap is secured along its lower edge to said carton front panel is also an available option. Other means for releasably securing said cover front flap to said carton front panel are also available and may be employed with equal facility so long as the convenience of a removable adhesive panel or tear strip is not a paramount consideration.

Whereas, throughout this application, reference has been made to a "score line", this is to be understood as equivalent to the term "score" as commonly used in the art and as generally meaning a press or crease score, as opposed to a cut score, although the equivalency of the various types of scores or score lines when they serve the same functional purpose without interfering with the efficiency of the carton will be readily apparent to those skilled in the art. In the present invention, cut scores are not necessary for any of the features which characterize the invention and the scores or score lines are accordingly referred to as "score lines" throughout and have the foregoing meaning except where otherwise indicated.

It is to be understood that the invention is not to be limited to the exact details of construction, operation, or exact materials or embodiments shown and described, as obvious modifications and equivalents will be apparent to one skilled in the art, for which reason the invention is to be limited only by the full scope which can be legally accorded to the appended claims.

I claim:

1. In an integral carton blank, adapted to be erected into a carton, said carton blank having a bottom panel, a front panel hingedly connected to said bottom panel, a rear panel hingedly connected to said bottom panel, a cover panel hingedly connected to said rear panel, and a cover panel front flap comprising tear-away means connected to said cover panel and adapted to overlap said front panel and to be releasably secured thereto in the erected carton, said bottom panel having end flaps hingedly connected thereto, said rear panel having end flaps hingedly connected thereto, said front panel having end flaps hingedly connected thereto, said cover panel having end flaps hingedly connected thereto, and said cover panel front flap having end posts hingedly connected thereto, said bottom panel, front panel, and rear panel end flaps being adapted to be folded in to form end walls in the erected carton, and said cover panel front flap end posts being adapted to overlie said cover panel end flaps and to be secured thereto in the erected carton to form a skirted cover, the improvement which comprises:

said bottom panel end flaps are adapted to be infolded so as to constitute the inner end walls of the erected carton, said front panel end flaps are adapted to overlie said said bottom panel end flaps in the erected carton, and said rear panel end flaps are adapted to overlie said bottom panel end flaps and to overlap said front panel end flaps in the erected carton, said bottom panel end flaps are full end flaps having an area adapted essentially to close an open end of a carton erected from said blank, said bottom panel end flaps have a recess along a major portion of an outer marginal edge thereof adapted to underlie the cover panel in the erected carton and of a depth corresponding generally to the thickness of the material of construction of said carton blank, said front panel end flaps are adapted to overlie a major area of the bottom panel end flaps in the erected carton and have, along an edge thereof adapted to be an upper edge thereof in the erected carton, a lip extending along a major portion of the reach thereof and adapted to coincide with said recess in said outer marginal edge of said bottom panel full end flaps in a closed carton erected from said blank, and said rear panel end flaps being adapted to overlie a minor area of said bottom panel full end flaps and to overlap said front panel ends flaps and to be secured thereto by single lines of adhesive extending from the bottom of the rearwardmost edges of said front panel end flaps along the edges thereof up to the cover panel end flap lower edges as they will be located in the erected carton.

2. The carton blank of claim 1, wherein said front panel end flaps have an opening therein adapted to mate with tuck-in-tabs provided on said cover panel end flaps in the erected carton and after the carton has been opened, and said cover panel end flaps are provided with tuck-in-tabs on marginal edges thereof adapted to be lower edges thereof in the erected carton, which tabs are adapted to engage said openings in said front panel end flaps upon reclosure of a carton erected from said blank for temporary securement of the cover in closed position during use.

3. The carton blank of claim 2, wherein said openings in said front panel end flaps are in the form of slits or slots adapted to receive and engage said tuck-in-tabs on said cover panel end flaps.

4. The carton blank of claim 1, wherein said front panel has a lip articulated thereto along an edge thereof adapted to be an upper edge in the erected carton, and is generally of the same length as said front panel upper edge except for a space left at each end of said lip to allow room for the front top edge of said bottom panel full end flap upon erection of a carton from said blank.

5. The carton blank of claim 1, wherein said blank has adhered thereto a liner of sheetform plastic material which is adhesively secured to an upper portion of said rear panel and extends approximately along the full width of said rear panel and said cover panel and is adhesively secured to said cover panel front flap.

6. The carton blank of claim 1, wherein score lines between said cover panel front flap and said cover panel front flap corner posts are offset slightly outwardly with respect to score lines between said cover panel end flaps and said cover panel to facilitate securement of said corner posts to outer surfaces of said cover panel end flaps upon erection of a carton from said blank.

7. The carton blank of claim 1, wherein said bottom panel full end flaps have an elongated extension along edges thereof adapted to be rear edges thereof in the erected carton adjacent edges thereof adapted to be top edges in the erected carton for purposes of providing rear corner support in and to further leakproof the erected carton.

8. The carton blank of claim 1, wherein an upper portion of each rear panel end flap has a downwardly and outwardly sloping edge to facilitate insertion of a cover panel end flap therebehind upon reclosure of a carton erected from said blank during use.

9. The carton blank of claim 8, wherein a lower portion of each rear panel end flap has a bulge with a downwardly and outwardly sloping dge near the lower marginal edge thereof.

10. A carton tube formed from an integral blank, said carton tube having a bottom panel, a front panel hingedly connected to said bottom panel, a rear panel hingedly connected to said bottom panel, a cover panel hingedly connected to said rear panel, and a cover panel front flap comprising tear-away means connected to said cover panel and overlapping said front panel and releasably secured thereto in the said bottom panel having end flaps hingedly connected thereto, said rear panel having end flaps hingedly connected thereto, said front panel having end flaps hingedly connected thereto, said cover panel having end flaps hingedly connected thereto, and said cover panel front flap having end posts hingedly connected thereto, said bottom panel, front panel, and rear panel end flaps being adapted to be folded in to form end walls in the erected carton, and said cover panel front flap end posts being adapted to overlie said cover panel end flaps and to be secured thereto in the erected carton to form a skirted cover, wherein:

said bottom panel end flaps are adapted to be infolded so as to constitute the inner end walls of the erected carton, said front panel end flaps are adapted to overlie said said bottom panel end flaps in the erected carton, and said rear panel end flaps are adapted to overlie said bottom panel end flaps and to overlap said front panel end flaps in the erected carton, said bottom panel end flaps are full end flaps having an area adapted essentially to close an open end of a carton erected from said blank, said bottom panel end flaps have a recess along a major portion of an outer marginal edge thereof adapted to underlie the cover panel in the erected carton and of a depth corresponding generally to the thickness of the meterial of construction of said carton blank, said front panel end flaps are adapted to overlie a major area of the bottom panel end flaps in the erected carton and have, along an edge thereof adapted to be an inner edge thereof in the erected carton, a lip extending along a major portion of the reach thereof and adapted to coincide with said recess in said outer marginal edge of said bottom panel full end flaps in a closed carton erected from said blank, and said rear panel end flaps being adapted to overlie a minor area of said bottom panel full end flaps and to overlap said front panel end flaps and to be secured thereto by single lines of adhesive extending from the bottom of the rearwardmost edges of said front panel end flaps along the edges thereof up to the cover panel end flap lower edges as they will be located in the erected carton.

11. The carton tube of claim 10 in flat folded condition.

12. The carton tube of claim 10 in squared-up condition.

13. The carton tube of claim 10 in squared-up condition and having one end closed by the folding in and adhesive securement of the end flaps thereof.

14. The carton tube of claim 10 filled with content and closed at both ends by adhesively secured end flaps thereof.

15. In a carton having a bottom panel, a front panel hingedly connected to said bottom panel, a rear panel hingedly connected to of said bottom panel, a cover panel hingedly connected to said rear panel, and a cover panel front flap comprising tear away means connected to said cover panel and overlapping said front panel and releasably secured thereto, said bottom panel having end flaps hingedly connected thereto, said rear panel having end flaps hingedly connected thereto, said front panel having end flaps hingedly connected thereto, said cover panel having end flaps hingedly connected thereto, and said cover panel front flap having end posts hingedly connected thereto, said bottom panel, front panel, and rear panel end flaps being folded in to form end walls, and said cover panel front flap end posts overlying said cover panel end flaps and secured thereto to form a skirted cover, the improvement which comprises:

said bottom panel end flaps are infolded to constitute the inner end walls, said front panel end flaps overlie said said bottom panel end flaps, and said rear panel end flaps overlie said bottom panel end flaps and overlap said front panel end flaps in the carton, said bottom panel end flaps are full end flaps having an area essentially closing an end of the carton, said bottom panel end flaps have a recess along a major portion of an outer marginal edge thereof which underlies the cover panel and of a depth corresponding generally to the thickness of the material of construction of said carton, said front panel end flaps overlie a major area of the bottom panel end flaps and have, along the upper edge thereof, a lip extending along a major portion of the reach thereof and coinciding with said recess in said outer marginal edge of said bottom panel full end flaps, and said rear panel end flaps overlie a minor area of said bottom panel full end flaps and overlap said front panel end flaps and are secured thereto by single lines of adhesive extending from the bottom of the rearwardmost edges of said front panel end flaps along the edges thereof and up to the cover panel end flap lower edges.

16. The carton of claim 15, wherein said front panel end flaps have an opening therein which is adapted to mate with a tuck-in-tab provided on said cover panel end flaps after the carton has been opened, and said cover panel end flaps are provided with tuck-in-tabs on lower marginal edges thereof, which tabs are adapted to engage said openings in said front panel end flaps upon reclosure of the carton for temporary securement of the cover in closed position during use.

17. The carton of claim 16, wherein said openings in said front panel end flaps are in the form of slits or slots adapted to receive and engage said tuck-in-tabs on said cover panel end flaps.

18. The carton of claim 15, wherein said front panel has a lip articulated thereto along an upper edge thereof, which is generally of the same length as said front panel upper edge except for a space left at each end of said lip, thus allowing room for the front top edge of said bottom panel full end flap.

19. The carton of claim 15, wherein said bottom panel full end flaps have an elongated extension along edges thereof adjacent their top edges for purposes of providing rear corner support in the carton.

20. The carton of claim 15, wherein score lines between said cover panel front flap and said cover panel front flap corner posts are offset slightly outwardly with respect to score lines between said cover panel end flaps and said cover panel.

21. The carton of claim 15, having a liner of sheet-form plastic material which is adhesively secured to an upper portion of said rear panel and extends approximately along the full width of said rear panel and said cover panel and is adhesively secured to said cover panel front flap.

22. The carton of claim 15, wherein an upper portion of each rear panel end flap is unsecured and has a downwardly and outwardly sloping edge to facilitate insertion of a cover panel end flap therebehind upon reclosure of said carton during use.

23. The carton of claim 22, wherein an lower portion of each rear panel end flap is secured and has a bulge with a downwardly and outwardly sloping edge near the lowermost marginal edge thereof.

24. A method of closing an end of a carton tube erected from a carton blank, said carton tube having a bottom panel, a front panel hingedly connected to said bottom panel, a rear panel hingedly connected to said bottom panel, a cover panel hingedly connected to said rear panel, and a cover panel front flap comprising tear-away means connected to said cover panel and overlapping said front panel and releasably secured thereto, said bottom panel having end flaps hingedly connected thereto, said rear panel having end flaps hingedly connected thereto, said front panel having end flaps hingedly connected thereto, said cover panel having end flaps hingedly connected thereto, and said cover panel front flap having end posts hingedly connected thereto, said bottom panel, front panel, and rear panel end flaps being adapted to be folded in to form end walls in the erected carton, and said cover panel front flap end posts being adapted to overlie said cover panel end flaps and to be secured thereto in the erected carton to form a skirted cover, wherein:

said bottom panel end flaps are adapted to be infolded so as to constitute the inner end walls of the erected carton, said front panel end flaps are adapted to overlie said said bottom panel end flaps in the erected carton, and said rear panel end flaps are adapted to overlie said bottom panel end flaps and to overlap said front panel end flaps in the erected carton, said bottom panel end flaps are full end flaps having an area adapted essentially to close an open end of a carton erected from said blank, said bottom panel end flaps have a recess along a major portion of an outer marginal edge thereof adapted to underlie the cover panel in the erected carton and of a depth corresponding generally to the thickness of the material of construction of said carton blank, said front panel end flaps are adapted to overlie a major area of the bottom panel end flaps in the erected carton and have, along an edge thereof adapted to be an upper edge thereof in the erected carton, a lip extending along a major portion of the reach thereof and adapted to coincide with said recess in said outer marginal edge of said bottom panel full end flaps in a closed carton erected from said blank, and said rear panel end flaps begin adapted to overlie a minor area of said bottom panel full end flaps and to overlap said front panel end flaps and to be secured thereto by single lines of adhesive extending from the bottom of the rearwardmost edges of said front panel end flaps along the edges thereof up to the cover panel end flap lower edges as they will be located in the erected carton, which comprises the steps of folding in said bottom panel full end flap, folding in said front panel end flap upon said bottom panel full end flap and inserting the lip thereof into said recess in the marginal edge of said bottom panel full end flap, folding in said cover panel end flap upon said bottom panel full end flap and said front panel end flap, applying adhesive to the front edge of said cover panel end flap or to the corner post on said cover panel front flap and along the edge of said front panel end flap and into contact with the adjacent area of said underlying bottom panel full end flap up to the lower edge of the cover panel end flap, and folding in the end post and the rear panel end flap to adhesively secure the same and complete the carton end.

25. A method of closing an end of a carton tube erected from a carton blank, said carton tube having a bottom panel, a front panel hingedly connected to said bottom panel, a rear panel hingedly connected to said bottom panel, a cover panel hingedly connected to said rear panel, and a cover panel front flap comprising tear-away means connected to said cover panel and overlapping said front panel and releasably secured thereto said bottom panel having end flaps hingedly connected thereto, said rear panel having end flaps hingedly connected thereto, said front panel having end flaps hingedly connected thereto, said cover panel having end flaps hingedly connected thereto, and said cover panel front flap having end posts hingedly connected thereto, said bottom panel, front panel, and rear panel end flaps being adapted to be folded in to form end walls in the erected carton, and said cover panel front flap end posts being adapted to overlie said cover panel end flaps and to be secured thereto in the erected carton to form a skirted cover, wherein:

said bottom panel end flaps are adapted to be infolded so as to constitute the inner end walls of the erected carton, said front panel end flaps are adapted to overlie said said bottom panel end flaps in the erected carton, and said rear panel end flaps are adapted to overlie said bottom panel end flaps and to overlap said front panel end flaps in the erected carton, said bottom panel end flaps are full end flaps having an area adapted essentially to close an open end of a carton erected from said blank, said bottom panel end flaps have a recess along a major portion of an outer marginal edge thereof adapted to underlie the cover panel in the erected carton and of a depth corresponding generally to the thickness of the material of construction of said carton blank, said front panel end flaps are adapted to overlie a major area of the bottom panel end flaps in the erected carton and have, along an edge thereof adapted to be an upper edge thereof in the erected carton, a lip extending along a major portion of the reach thereof and adapted to coincide with said recess in said outer marginal edge of said bottom panel full end flaps in a closed carton erected from said blank, and said rear panel end flaps being adapted to overlie a minor area of said bottom panel full end flaps and to overlap said front panel end flaps and to be secured thereto by single lines of adhesive extending from the bottom of the rearwardmost edges of said front panel end flaps along the edges thereof up to the cover panel end flap lower edges as they will be located in the erected carton, wherein said front panel has a lip articulated thereto along an edge thereof adapted to be an upper edge in the erected carton, and is generally of the same length as said front panel upper edge, except for a space left at each end of said lip to allow room for the front top edge of said bottom panel full end flap upon erection of a carton from said blank, which comprises the steps of folding in said bottom panel full end flap, until it contacts the end of said lip at the upper edge of said front panel and lies in close juxtaposition thereto, folding in said front panel end flap upon said bottom panel full end flap and inserting the lip thereof into said recess in the marginal edge of said bottom panel full end flap, folding in said cover panel end flap upon said bottom panel full end flap and said front panel end flap, applying adhesive to the front edge of said cover panel end flap or to the corner post on said cover panel front flap and along the edge of said front panel end flap and into contact with the adjacent area of said underlying bottom panel full end flap up to the lower edge of the cover panel end flap, and folding in the end post and the rear panel end flap to adhesively secure the same and complete the carton end.

26. The method of claim 25, wherein said carton blank also comprises an elongated extension along the edges of said bottom panel full end flaps which are adapted to be the rear edges thereof in the erected carton adjacent the edges thereof adapted to be the top edges in the erected carton, and wherein said bottom panel full end flap elongated extension is folded in along with said bottom panel full end flap and caused to lie against the carton rear panel thereby to provide rear corner support in and the further leakproof the erected carton.

27. The carton claim 15, wherein an upper portion of each rear panel end flap comprises a breakaway tab, defined in said upper portion of said rear panel end flap by a line of weakness, which breakaway tab is adhesively secured to an underlying portion of a carton cover panel end flap.

28. The carton of claim 27, wherein said adhesive is provided as an extension or continuation of the single line of adhesive whereby the front and rear panel end flaps are secured together.

29. The carton of claim 27, wherein a rearwardmost portion of each of the cover panel end flaps is adhesively unsecured to an overlying upper segment of a rear panel end flap but remains attached to the breakaway tab thereof upon opening of the carton, thereby providing a retuck tab adapted to be reinserted in a recess behind a remaining and unsecured upper portion of a rear panel end flap for stabilization of the carton upon reclosing of the same.

30. A carton blank of claim 1, wherein an upper portion of each rear panel end flap comprises a breakaway tab, defined in said upper portion of said rear panel end flap by a line of weakness, which breakaway tab is adapted to be adhesively secured to an underlying portion of a carton cover panel end flap.

31. A method of any one claims 24 through 26, wherein the carton blank and carton tube comprise breakaway tabs, defined in upper portions of said rear wall panel end flaps by lines of weakness, wherein adhesive is applied up onto cover panel end flaps in a location adapted to underlie the said breakaway tabs upon folding in of said carton rear wall panel end flaps, and wherein the said breakaway tabs are secured to underlying portions of cover panel end flaps.

* * * * *